US007150660B2

(12) United States Patent
Allgood et al.

(10) Patent No.: US 7,150,660 B2
(45) Date of Patent: Dec. 19, 2006

(54) HIGH CURRENT AUTOMOTIVE ELECTRICAL CONNECTOR AND TERMINAL

(75) Inventors: Christopher Lee Allgood, Lexington, NC (US); Jimmy Glenn Grubbs, Walkertown, NC (US); Jeremy Christin Patterson, Mcleansville, NC (US); Garold Micheal Yurko, Jamestown, NC (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/480,108

(22) PCT Filed: Sep. 21, 2002

(86) PCT No.: PCT/US02/29877

§ 371 (c)(1),
(2), (4) Date: Jul. 14, 2005

(87) PCT Pub. No.: WO03/028160

PCT Pub. Date: Apr. 3, 2003

(65) Prior Publication Data

US 2006/0014442 A1 Jan. 19, 2006

(51) Int. Cl.
*H01R 11/22* (2006.01)

(52) U.S. Cl. ..... 439/845; 439/852

(58) Field of Classification Search ..... 439/854, 439/845, 843, 852

See application file for complete search history.

(56) References Cited

U.S. PATENT DOCUMENTS

| | | | | |
|---|---|---|---|---|
| 4,772,218 | A | 9/1988 | Ross | 439/387 |
| 4,934,965 | A | 6/1990 | Buddrus et al. | 439/845 |
| 5,078,622 | A | 1/1992 | Hunt, III et al. | 439/589 |
| 5,340,338 | A | 8/1994 | Sai et al. | 439/845 |
| 5,449,304 | A | 9/1995 | Huss, Jr. et al. | 439/843 |
| 5,588,884 | A | 12/1996 | Rudoy et al. | 439/845 |
| 5,613,885 | A | 3/1997 | Plate et al. | |
| 5,679,034 | A | 10/1997 | Hanazaki et al. | 439/845 |
| 5,921,797 | A | 7/1999 | Bass et al. | 439/342 |
| 6,089,929 | A | 7/2000 | Sloey | 439/845 |
| 6,276,960 | B1 | 8/2001 | Schaefer et al. | 439/522 |
| 6,287,156 | B1 | 9/2001 | Swan et al. | 439/845 |

FOREIGN PATENT DOCUMENTS

| | | |
|---|---|---|
| DE | 3906625 C1 | 1/1990 |
| WO | WO 00/14828 | 3/2000 |

OTHER PUBLICATIONS

See PCT International Search Report for any references that are not enclosed herewith.

*Primary Examiner*—Truc Nguyen

(57) ABSTRACT

A terminal 20 for use in connecting a battery cable 9 to a rectangular blade 4 on a battery 2 includes a terminal body 22 and a spring member or multiple contact band 70. The spring member 70 is fabricated from a material that is more elastic than the terminal body 22 to reduce mating force, but still generate sufficient normal force to provide a good connection to the rectangular blade 4. The multiple contact spring band 70 has a plurality of spring beams in the form of twisted louvered spring beams 78 or curved spring beams 80. The spring member 70 is positioned within a receptacle section 30 of the terminal body 22 that includes two parallel walls 32, 46. The terminal body 22 also includes a wire termination section for attaching the terminal 20 to a battery cable 8. Inline and right angle versions of the terminals employ similar spring members 70.

23 Claims, 9 Drawing Sheets

HIGH CURRENT AUTOMOTIVE ELECTRICAL CONNECTOR AND TERMINAL

This invention relates to a battery terminal for connecting a battery cable to a rectangular blade on the battery. This invention is also related to 36 volt batteries intended for use in motor vehicles.

Conventional 12 volt batteries used in motor vehicles employ round posts as the positive and negative outputs from the battery. These round posts have resulted in numerous problems because of the difficulty of maintaining a reliable connection between cables attached to the battery and the round posts. Corrosion can result in an open circuit at the battery posts, and the battery terminals conventionally used for round posts can be difficult to attach to the round battery posts in manner that will insure a reliable connection.

With the increase in the number of electrical and electronic components in automobiles and motor vehicles, the conventional 14 volt electrical system using a standard 12 volt battery, has become a limitation on the features that may be included in the vehicle electrical system. The relatively high currents that are necessary in the conventional electrical system result in excessive losses. Therefore it has been proposed to upgrade the electrical system in new motor vehicles to a 42 volt system that would use a 36 volt battery. In this way electrical power can be delivered to components without the large currents and associated losses inherent in the present system. The introduction of a new electrical system and a new standard battery will also allow improvements in the mechanical and electrical connections to the battery. It has been proposed that the conventional round battery posts be replaced by rectangular blades that can provide a more stable and reliable electrical connection. These rectangular blades can also be positioned within a shrouded header so that an electrical connector attached to the battery cable can be mated to the battery blades and a seal can be established that would reduce environmental contamination at the battery connection.

A battery terminal that could be connected to a rectangular battery blade must be capable of carrying a relatively high current. However, high current connections typically require high normal forces, which in turn lead to high mating forces. If the mating force is too high, then the reliability of the connection may be open to question, because relatively inexperienced users may not adequately mate the battery terminal to the rectangular battery blade. If the battery connector containing the terminal is not fully mated the seal intended to protect the connection may also be incomplete.

One prior art approach to establishing a low mating force, high current electrical connection that has been employed in certain applications has been the use of multiple contact spring bands mounted on the body of a terminal that is attached to a wire. These bands are typically used with pin and socket contacts that have a round cross section. Examples of terminals of this type are shown in U.S. Pat. No. 5,078,622; in U.S. Pat. No. 5,449,304 and in U.S. Pat. No. 5,474,79. Multiple contact spring bands have also been proposed for use in terminals that would be suitable for mating to rectangular male terminals. An example of a multiple contact spring band that has been proposed for use with rectangular male terminals is shown in U.S. Pat. No. 5,340,338. This terminal was, however, intended for use in a multiple contact electrical connector, and is believed to have been too small for use as a battery terminal. This latter multiple contact spring band or spring member must also be staked to an outer terminal body, resulting in what appears to be a relatively expensive manufacturing or fabrication operation. In order to be suitable for use as a battery terminal, a simpler means of mounting the multiple contact spring band in an exterior terminal body would be needed.

The instant invention provides a relatively high current or high power battery terminal that requires a relatively low force to mate the terminal to a rectangular blade mounted on the battery. This battery terminal includes multiple contact bands or spring members that can be economically mounted in a terminal body that includes a wire termination or crimp section for attaching the cable to the battery. The terminal may also be mounted in an insulative housing that can be mated with a shrouded header on the battery to establish a sealed interconnection. This invention also provides a simple and economical means for mounting the spring member in an external housing to form a battery connector. The terminal and connector can also be used for connection to other components within a motor vehicle electrical system and is not limited to use as a battery connector or battery terminal. The connector and terminal can also be used in other applications and is not limited to use in automobiles or motor vehicles.

According to this invention, a terminal for connection to a flat blade includes a terminal body and multiple contact bands. The terminal body includes a wire termination section and a pair of opposed flat walls and a pair of multiple contact bands formed from a material having a greater elasticity than the terminal body. One of the multiple contact bands is positioned along an interior surface of each terminal body wall. Each contact band includes spring beams. The contact bands are positioned so that the spring beams are deflected when the flat blade is received between opposed contact bands. Clips surrounding front edges of the opposed walls of the terminal body are used to attach the multiple contact bands to the terminal body. These clips can either be an integral part of the multiple contact spring bands or they can be part of a shroud that surrounds the terminal body and the ends of the multiple contact spring bands. Other attachment means are also possible. The multiple contact spring bands or spring members can be easily inserted into a terminal body that has already been formed into its final shape.

This terminal in intended for use in an electrical connector and the terminal includes a terminal body having a receptacle section joined to a wire termination section. The terminal also includes a spring member positioned with the receptacle section. One embodiment of the spring member is a stamped and formed member including opposed arrays of individual spring beams joined at rear ends by an inwardly folded section extending between the opposed arrays. Each array of spring members is joined at front ends to a clip outwardly folded around a forward end of the terminal body receptacle section. The spring member engages both the terminal body and a mating terminal blade received between the opposed arrays of individual spring beams.

A terminal of this type can be used in battery connector for connection to a rectangular battery header blade on a 36 volt battery. The battery header blade is located within a cavity. The battery connector includes a single battery terminal positioned within a surrounding housing. The housing is insertable into the cavity with the single battery terminal engaging the rectangular battery blade. This battery terminal includes a terminal body attachable to a battery cable. Opposed, flat, parallel wall sections adjacent a front end of the terminal body comprise a receptacle section in which spring members are positioned. Two stamped and formed spring members with a greater elasticity than the terminal body and a plurality of side-by-side spring beams are positioned on an interior surface of one of the wall sections. The two stamped and formed spring members are located in opposing relationship. When a rectangular battery blade is received between the two stamped and formed spring members, they deflect the spring members so that the battery terminal can be mated to the rectangular battery blade without excessive mating force.

The invention will now be described by way of example with reference to the accompanying drawings wherein.

Figure 1:
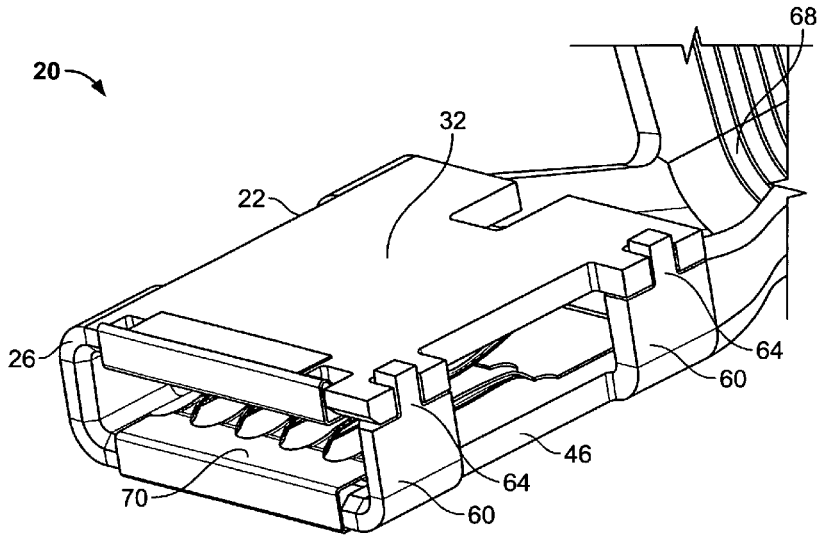
FIG. 1 is a three dimensional view of a terminal, that could be used to connect a battery cable to a rectangular blade or post on a battery used in a 36 volt automotive electrical system. This first embodiment of a terminal includes louvered multiple contact bands.

A rectangular terminal blade of the type intended for use with a 36 volt battery for use in a 42 volt automotive electrical system requires a different battery connector or terminal to attach a battery cable to the battery. Several distinct embodiments of a battery terminal suitable for use with a rectangular battery blade are disclosed herein. The first embodiment is shown in FIGS. 1–7. The battery terminal 20 of this embodiment includes a terminal body 22 and a stamped and formed spring member or multiple contact band 70 having louvered spring beams 78. Both the terminal body 22 and the multiple contact band 70 are stamped and formed members. The terminal body 22 is stamped and formed from a conventional metal that is used for electrical connector terminals of the type that are crimped to wires or cables. The spring member 70 is fabricated from a material that is more elastic than the terminal body 22. For example the spring member or multiple contact band 70 can be fabricated from beryllium copper or other materials.

The terminal body 20 includes a receptacle section 30 and a wire termination section 68 that serves as a means for terminating a battery cable to the terminal 12. The wire termination section 68 of the preferred embodiment is a conventional wire crimp section including an insulation strain relief in addition an open barrel for crimping the conductive core of the battery cable. The wire termination section 68 is joined to the rear of a receptacle section 30, and the terminal body 22 comprises a one-piece member.

The receptacle section 30 has a flat wall 32 and a flat bottom wall 46. The top wall extends from a front edge 36 to a rear edge 40 and includes an interior surface 34 facing the center of the terminal body. The bottom wall 46 also has an interior surface 48 extending between a bottom wall front edge 50 and rear edge 54. Bottom wall interior surface 48 is opposed to the top wall interior surface 34. Both the top wall 32 and the bottom wall 46 should be flat and parallel in the stamped and formed configuration so that the contact spring band 70 will not be canted relative to the terminal body 22.

The top receptacle wall 32 has two slots 38 adjacent the side of the front edge 36, and a single slot 42 located in the center of the rear edge 40. The bottom receptacle wall 46 also has two front slots 52 aligned with the slots 38 in the top wall 32. A rear bottom wall slot, not shown, is aligned with the rear top wall slot 42. These slots serve as a means for securing the spring members 70 to the terminal body 20 in a manner that will be subsequently discussed in more detail.

Figure 2:
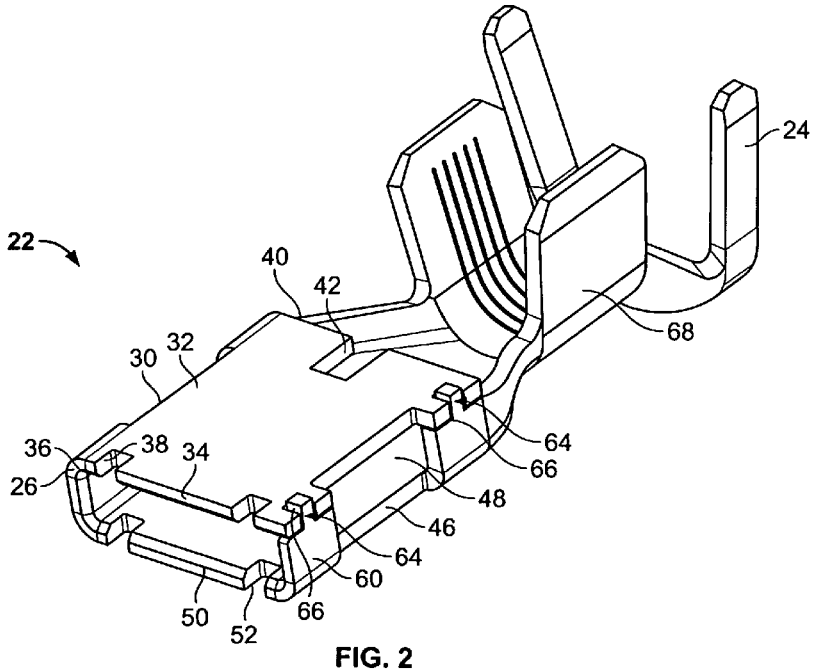
FIG. 2 is a three dimensional view of a stamped and formed terminal body in which a multiple contact band can be positioned.

The top wall 32 is joined to the bottom wall 46 by four strap sections 60 located at the corners of the top wall 32 and the bottom wall 46. The terminal body 22 is stamped from a flat blank, and these strap sections 60 are formed by removing material adjacent to the top wall 32 and the bottom wall 46. Two of these strap sections 60 extend between adjacent side edges of the top wall 32 and the bottom wall 46. The other two strap sections 60 extend from a free side edge of the bottom wall. The depth of width of all four strap sections 60 is less than the depth of the walls 32, 46, and these narrower strap sections are bent to form the flat stamped blank into a formed terminal having flat walls 32, 46 is opposed parallel relationship, Since the strap sections 60 are narrower, less force is required to form the strap sections at right angles relative to the flat walls 32, 46. It should be understood, however, that the strap sections 60 are strong enough to hold their shape, once formed and hold the two walls in proper position. Each of the strap sections 60 extending from a free edge of the bottom wall (the front strap sections 60 as seen in FIGS. 1 and 2) includes a tongue 64 protruding from the upper end of the strap section 60. These tongues 64 are dimensioned to fit within notches 66 located a corners of the free edge of the top wall 32. When the terminal body 22 is formed into a rectangular configuration, the tongues 64 are aligned with the notches 64.

Initially the tongues 64 extend above the top surface of the top wall 32 as shown in FIGS. 1 and 2. However, once the terminal body 22 is formed into a rectangular configuration, the tops of the tongues 64 can be swaged or pressed so that they will laterally expand to lock the tongues 64 in notches 66 and secure the top wall 32 in permanent parallel, opposed relationship to the bottom wall 46. The portions of the top wall surrounding the notches will be trapped between the swaged or enlarged end of the tongues 64 and the end surfaces on of the strap sections 60 on opposite sides of each tongue 64.

Figure 5:
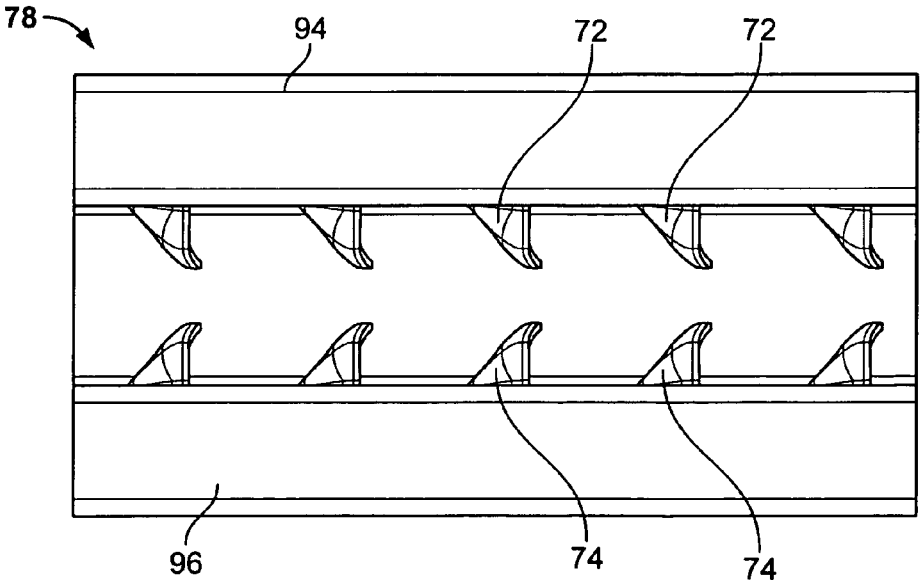
FIG. 5 is a front view of the louvered multiple contact band shown in FIGS. 3 and 4.

A rectangular opening is bounded by the front wall edges 36 and 50 and by the front strap sections 60. This rectangular opening is large enough to permit insertion of a stamped and formed spring member 70 having louvered spring beams 78 into a position between the interior top and bottom surfaces 34 and 48. A rectangular blade can then be inserted through this opening into engagement with the stamped and formed spring member or multiple contact band 70. The multiple contact spring band 70 employed in the first embodiment of this invention has a top spring beam array 72 and a bottom spring beam array 74. Each spring beam array has a plurality of side-by-side louvered spring beams 78 joined at front ends 82 and rear ends 84 to the rest of the spring member 70. As shown in FIG. 5, these louvered spring beams in the top array 72 and the bottom array 74 are twisted adjacent their ends so that adjacent spring beams lie in a series of inclined, substantially parallel planes. The twisted louvered spring beams 78 in the top array extend transversely relative to the spring beams in the bottom array or row. With the spring beams 78 twisted in this manner, they reduce the space between opposite arrays of spring beams and their innermost edges are positioned to engage a rectangular or flat blade received between the spring beams to establish a reliable electrical contact.

The spring member 70 of this first embodiment is a one-piece folded member in which the top spring beam array 72 is joined to the bottom spring beam array 74 by a central web 86 that extends transversely relative to the two arrays. In this preferred embodiment, the central web or inwardly folded section 86 is substantially perpendicular to the spring beam arrays 72, 74 to form a substantially U-shaped member. Flat sections 88, 90 are located between a central transverse section 92 of the central web 86, and similar flat sections are located on the front of the spring beams. Outwardly folded clips 94 and 96, also having a substantially U-shaped configuration are located on the front of the spring member 70. These clips 94 and 96 have a width, at least equal to the thickness of the terminal body top and bottom walls 32, 46, so that the clips substantially surround the front edges 36, 50 of the terminal body receptacle section 30. Each clip 94, 96 also includes a pair of rearwardly facing front lances 98 along opposite edges. The width of these lances 98 is approximately equal to the width of the terminal body front edge slots 38, 52 so that the lances 98 fit into the slots 38, 52. When the spring member 70 has been inserted through the front opening into position between the top wall 32 and the bottom wall 46, the clips 94, 96 and the front lances 98 will act as stop surfaces preventing the spring member 70 from entering further into the terminal body 22. When a rectangular blade is inserted into the terminal 20, these clips 94, 96 and front lances 98 will prevent the spring member 70 from being pushed further into the terminal body 22, and will thus secure the spring member 70 to the terminal body 22.

Figure 3:
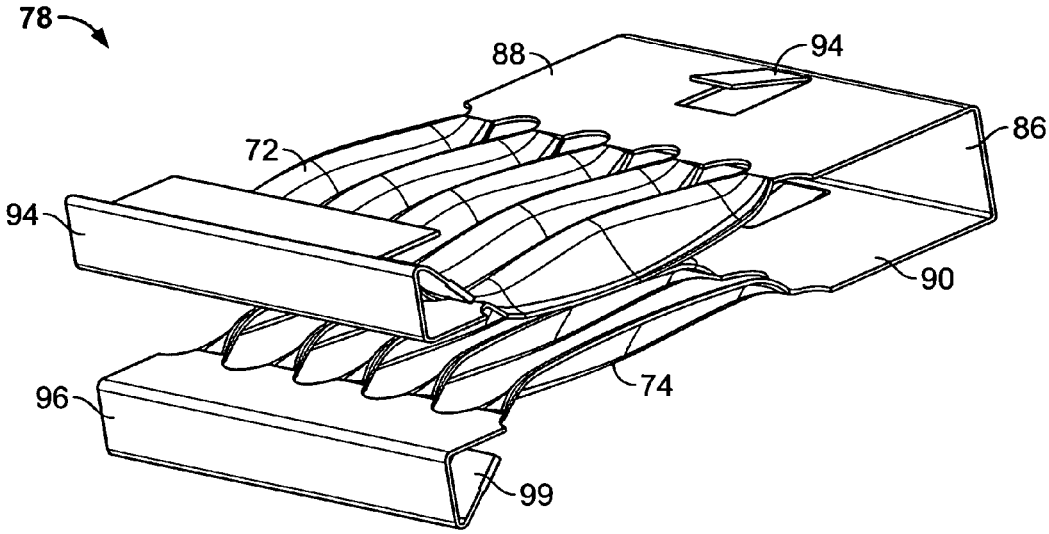
FIG. 3 is a three dimensional view of a louvered multiple contact band that can be positioned in the terminal body shown in FIG. 2 to form the terminal shown in FIG. 1.
Figure 4:
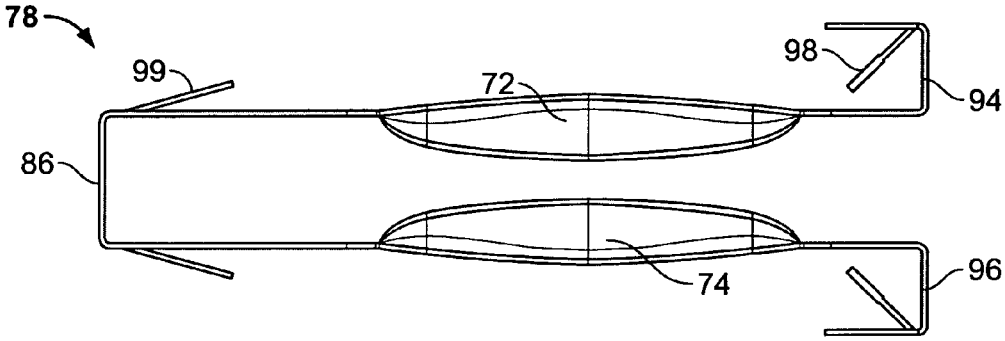
FIG. 4 is a side view of the louvered multiple contact band shown in FIG. 3.

The spring member 70 also includes two rear, forwardly facing lances 99 extending outwardly from the top wall 32 and the bottom wall 46. These lances 99 are struck outwardly from a root section in the central web 86, as best seen in FIGS. 3 and 4. The width of these rear lances 99 is approximately equal to the width of receptacle rear top slot 42 and a corresponding bottom slot, not shown, so that the rear lances 99 are received in the rear slots 42, 56. These lances 99 will prevent extraction of the spring member 70 from the terminal body 22. Since the lances 99 are flexible, they can be deflected to permit insertion of the spring member 70 into the terminal body 22. The lances 99 will also prevent extraction of the spring member 70 when a rectangular terminal blade is removed from the terminal 20.

Figure 6:
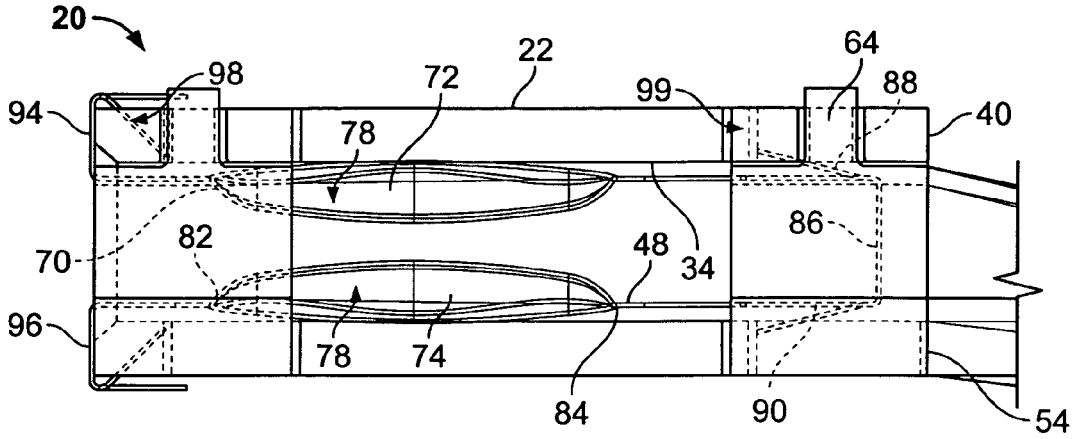
FIG. 6 is a sectional side view of the terminal in FIG. 1, showing the manner in which a louvered multiple contact band can be positioned between a top and bottom wall forming the receptacle section of the terminals shown in FIG. 1.
Figure 7:
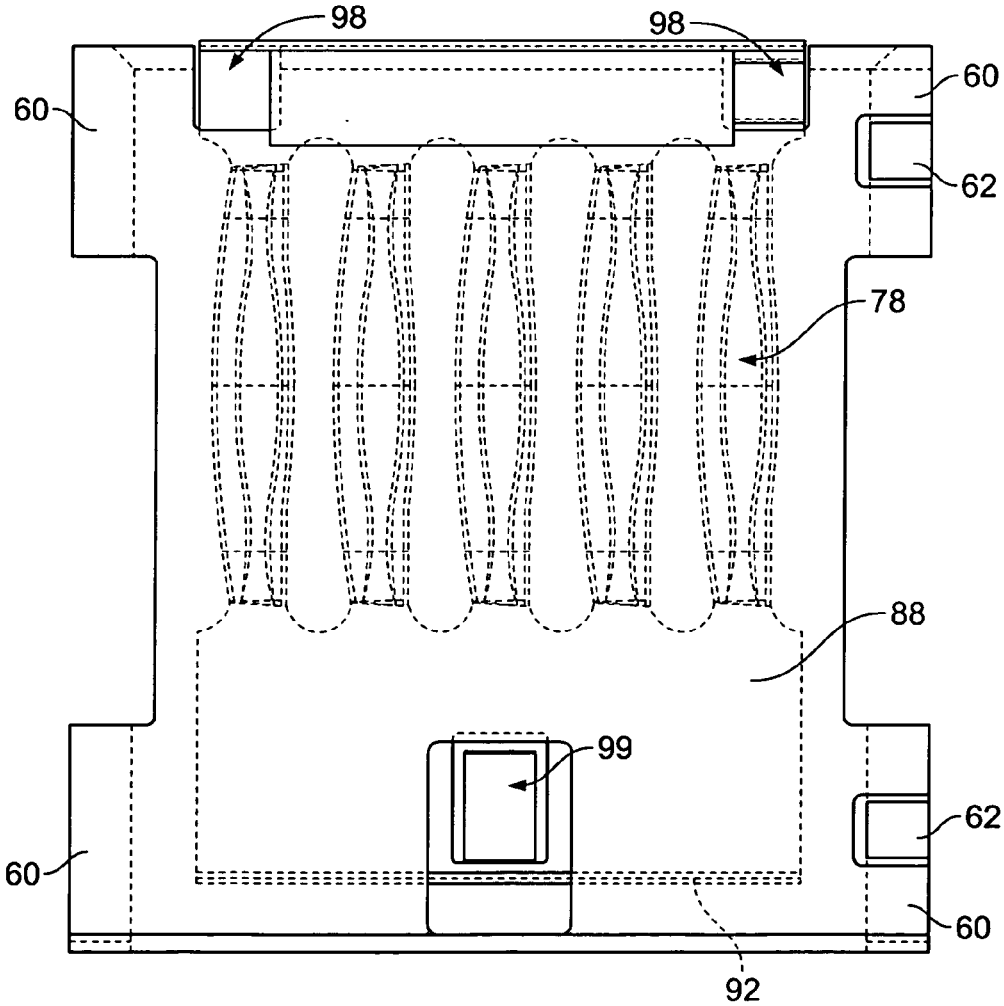
FIG. 7 is a sectional top view of the terminal shown in FIGS. 1 and 6.

As shown in FIG. 6 one set of edges on the louvered spring beams 78 engage the interior wall surfaces 34, 48 to maintain a reliable electrical contact with the terminal body 20. The opposite edges of the louvered spring beams 78 will engage a rectangular terminal blade inserted between the top spring beam array 72 and the bottom spring beam array 74. Opposite edges of the louvered spring beams 78 will therefore engage the terminal body receptacle section 30 and the rectangular blade establishing a reliable electrical contact. The spring member 70 will be deformed when a rectangular blade is received between the top and bottom arrays 72, 74 of louvered spring beams 78. The rear section of the spring member 70 is not anchored to the terminal body 22 in a manner that will prevent longitudinal movement of the rear section of the spring member 70. Only the front of the spring member is constrained against rearward movement. The spring member can thus expand as a rectangular blade is inserted into the receptacle section 30. The transverse walls section 92 is however positioned to prevent over insertion of a blade into the terminal 20. Since the spring member 70 is fabricated from a metal that is more elastic than the metal forming the terminal body 22, lower insertion or mating forces will be required to mate a rectangular blade to the terminal 20 than would be necessary if deflection of the terminal body were required.

Figure 8:
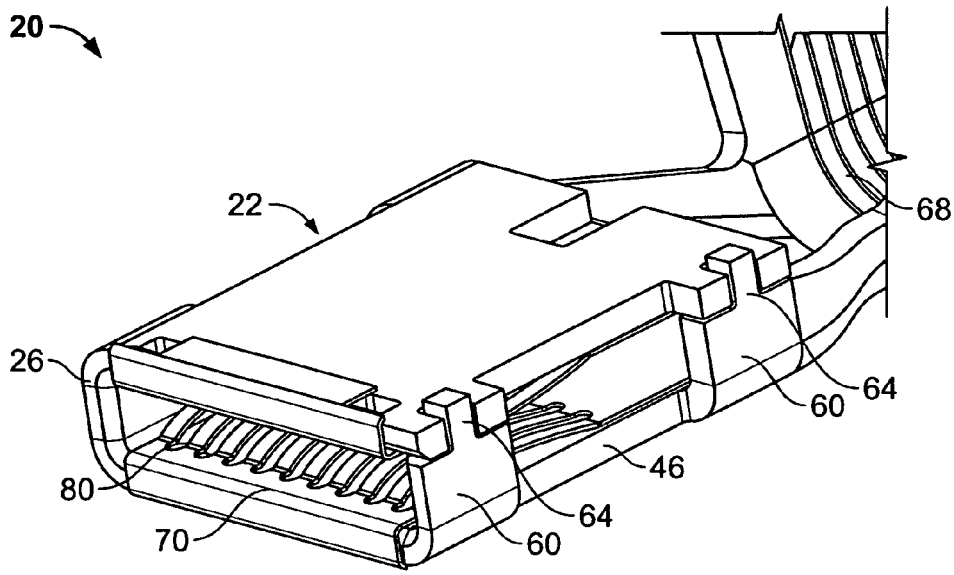
FIG. 8 is an alternate view of a terminal similar to the terminal shown in FIG. 1, but employing curved spring beams, all lying within a curved surface, instead of the louvered contact bands used in the embodiment of FIG. 1.
Figure 9:
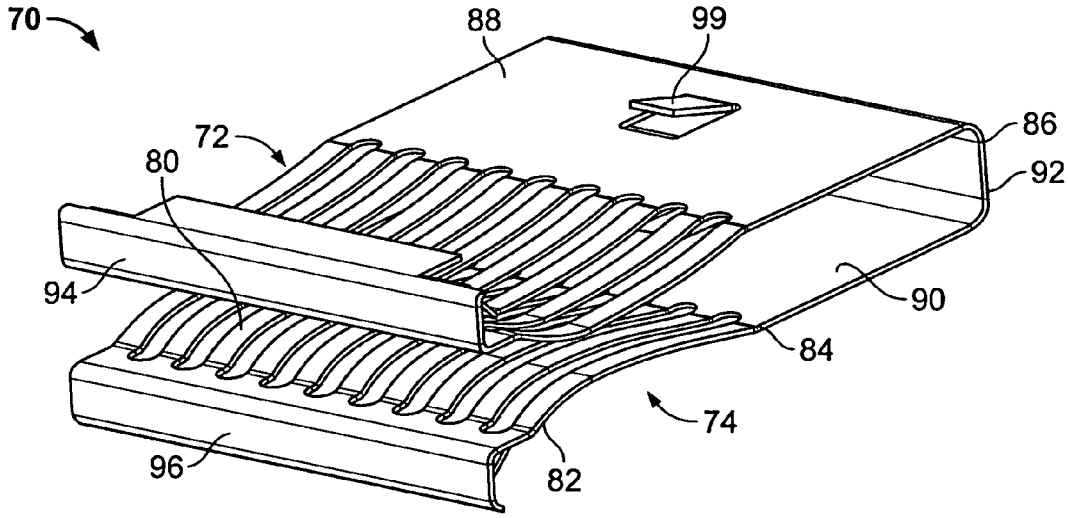
FIG. 9 is a three dimensional view of the multiple contact band used in the terminal of FIG. 8.
Figure 10:
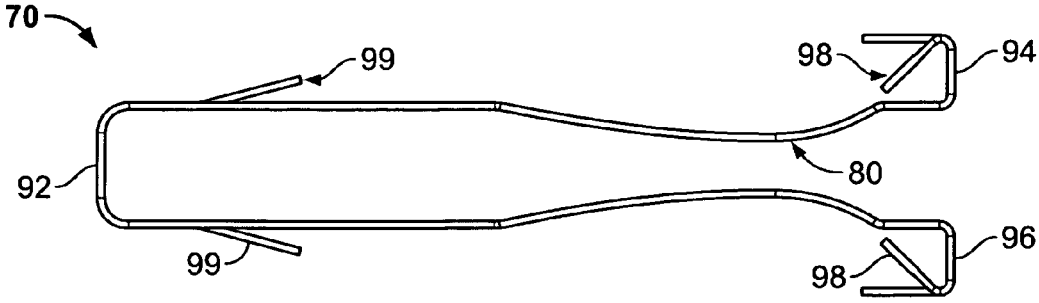
FIG. 10 is a side view of the contact band shown in FIG. 9.
Figure 11:
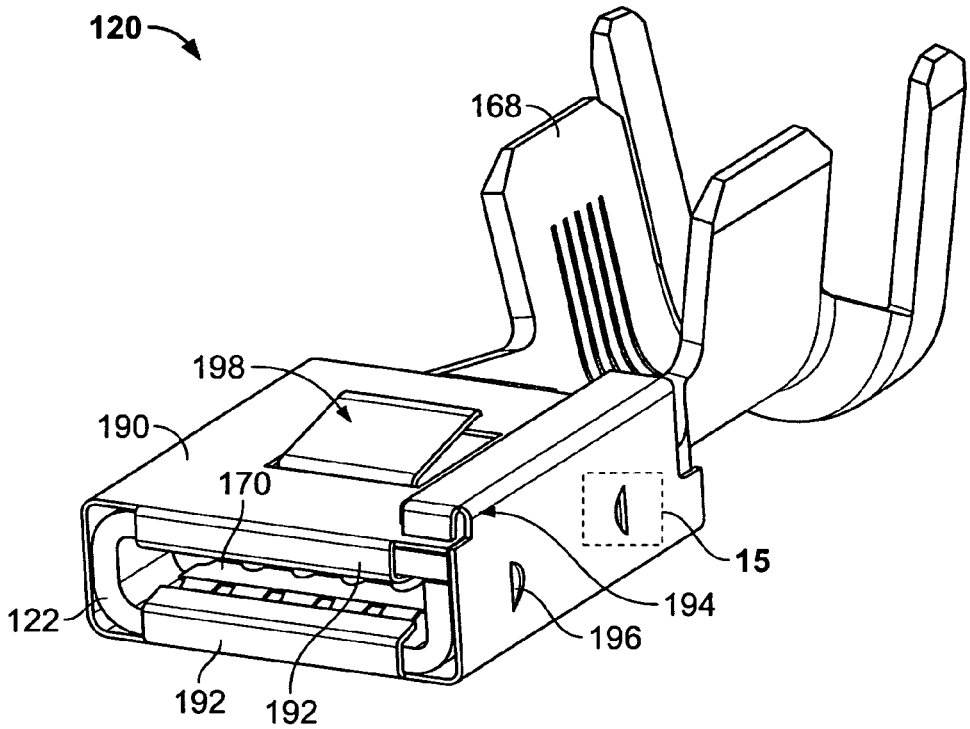
FIG. 11 is a three dimensional view of another alternate embodiment of this invention employing shroud surrounding the terminal body.

A second embodiment of this invention is shown in FIGS. 8–10. This embodiment is similar to the embodiment of FIGS. 1–7, but this second embodiment uses a different stamped and formed spring member 70. The spring member or multiple contact band 70 of the embodiment of FIGS. 8–10 does not have the twisted louvered spring beams 78 shown in FIGS. 3–5. As shown in FIGS. 9 and 10 the spring members 80 comprise curved spring beams joined at their opposite ends 82 and 84 to the remainder of the spring member 70. All of these curved spring beams 80 have the same curvature or shape and all of the curved spring beams 80 in the top array 72 lie in a common curved surface. The curved spring beams 80 in the bottom array 74 also lie in a common curved surface. Alternatively it can be said that the curved spring beams 80 in each array define a curved surface. These curved spring beams 80 extend inwardly from flat surfaces, on the front and back of the beam arrays, toward the center of the terminal 20 or toward the center of the space formed on the interior of the terminal body 22. The top bean array 72 and the bottom beam array 74 thus form a constricted section into which a rectangular blade can be received or inserted. Contact points or contact areas at the center of the curved spring beams 80 will engage a rectangular blade. Since the blade will be thicker than the space between opposed spring beams in the arrays 72 and 74, the beams will be deflected outwardly generating a contact force that will maintain a good electrical contact with the blade. The front beam ends 82 and the rear beam ends 84 will in turn bear against the top wall interior surface 34 and the bottom wall interior surface 48 to maintain a sound electrical contact with the terminal body 22. Since the curved beams 80 will be somewhat flattened when the blade in inserted between opposed beams, the rear of the spring member 70 will move rearwardly. However, the spring member 70 is held in engagement with the terminal body 22 by the clips 94 and 96 and by the front lances 98, so that remainder of the contact bands 70 are free to move. Adequate space for this longitudinal movement, or expansion, is provided on the interior of the terminal body 22. The curved spring beams 80 will exhibit a greater deflection that the relatively stiffer twisted louvered spring beams 78, and should require less force to deflect the beams. One type of spring beam will have advantages in certain applications and another type of spring beam will have advantages in other applications.

Either the louvered spring beams 78 and the curved spring beams 80 can be inserted into the same terminal body 22 shown in FIG. 2. Slight dimensional variations in the terminal body used with different spring members 70 could be necessary for certain applications, but these dimensional changes would be readily apparent to one of ordinary skill in the art.

Figure 12:
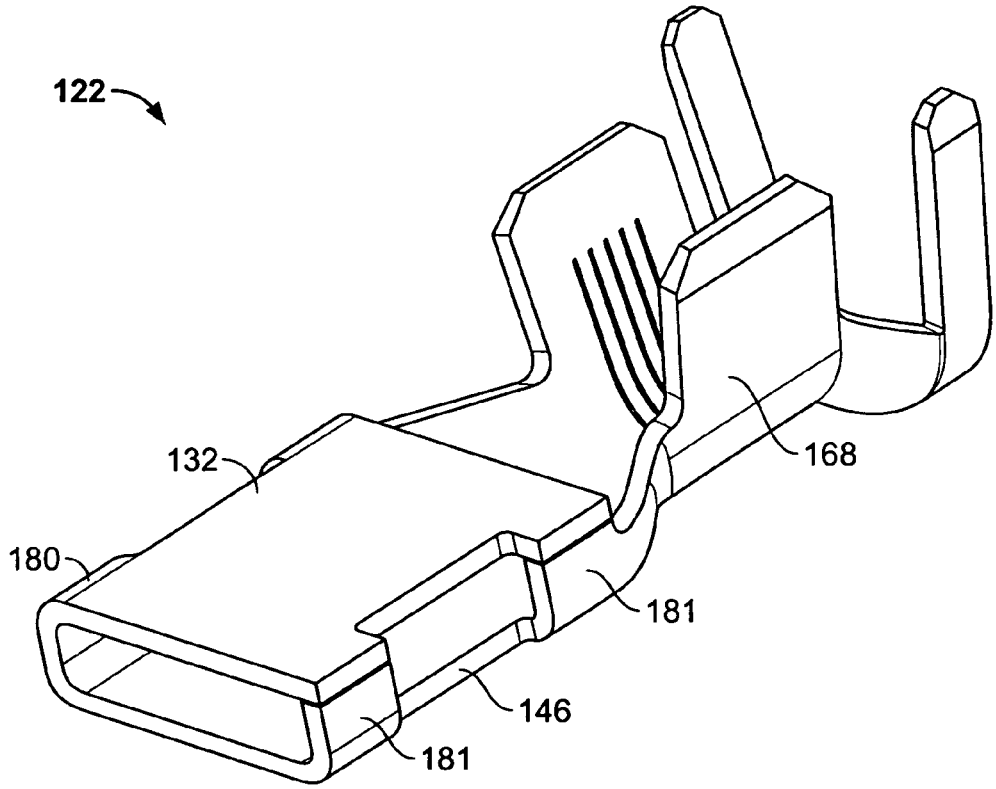
FIG. 12 is a three dimensional view of a terminal body that is used in the terminal of FIG. 11.
Figure 13:
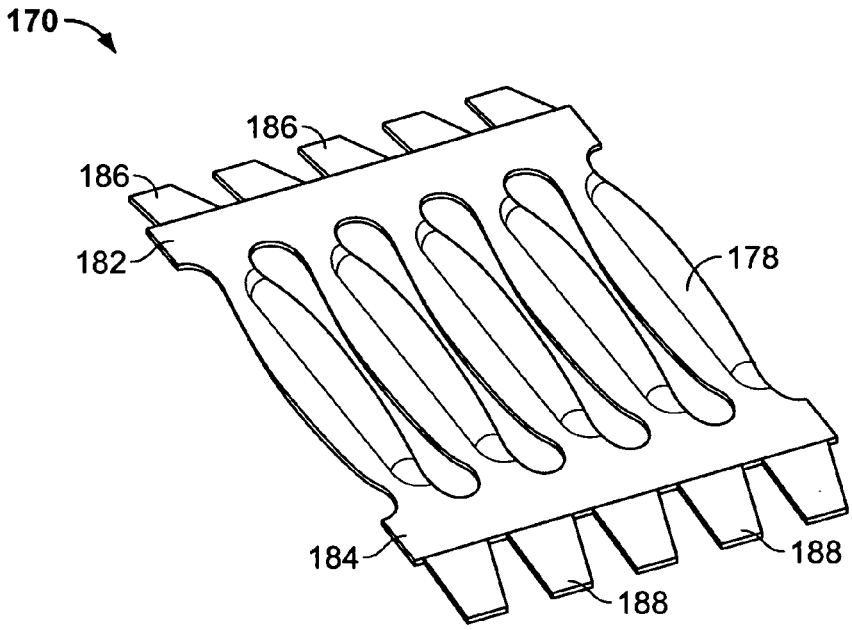
FIG. 13 is a view of a single contact band that is used in the embodiment of FIG. 11.
Figure 14:
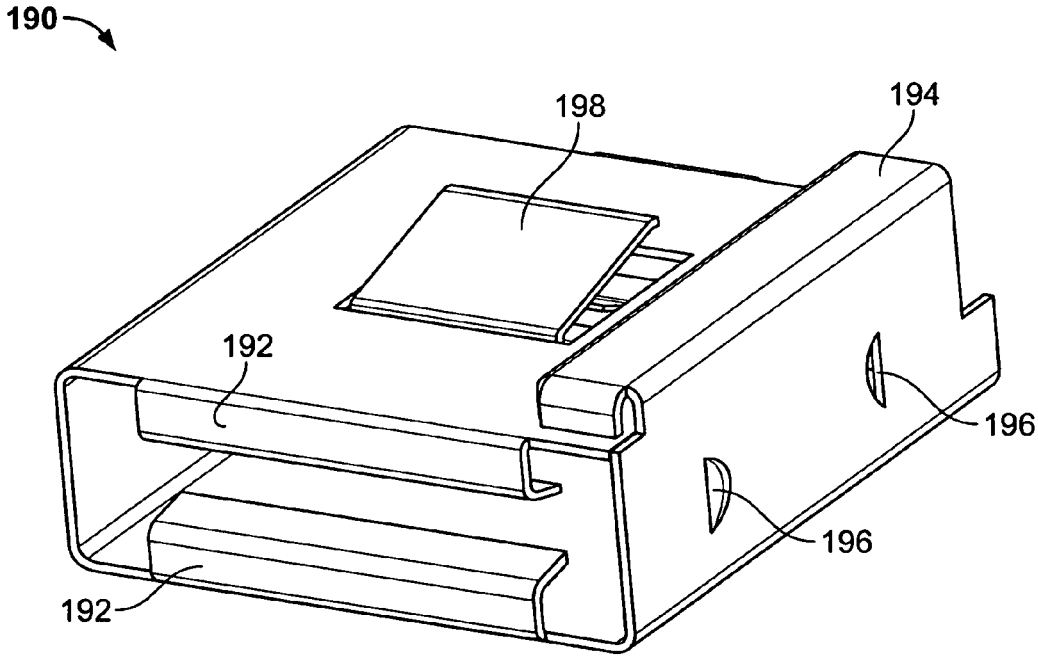
FIG. 14 is a view of the stamped and formed shroud that is used to hold the contact band of FIG. 13 in engagement with the terminal body of FIG. 12. Identical contact bands are used on the top and bottom of the terminal.
Figure 15:
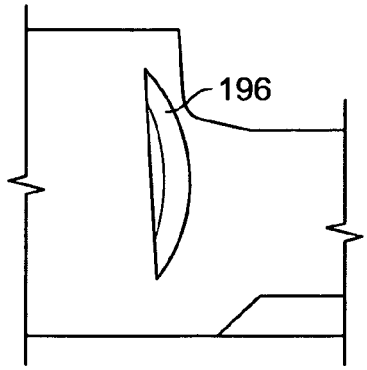
FIG. 15 is a view of the indents used to secure the shroud of FIG. 14 to the terminal body of FIG. 12.

A third embodiment of this invention is shown in FIGS. 11–15. This embodiment differs from the first and second embodiments in that two separate spring members or multiple spring bands 170 are positioned along opposed top and bottom terminal body walls 132 and 146 respectively. As shown in FIG. 13, louvered spring beams 178 are employed in this representative embodiment. It should be understood that curved spring beams, similar to the curved beams 80 used in the second embodiment could also be used in this embodiment. The louvered spring beams 178 are joined near opposite ends by lateral strips 182 and 184 that join all of the spring beams in a single spring band 170 together. Fingers 186 and 188 extend beyond the strips 182 and 184, and individual fingers 186, 188 are longitudinally aligned with individual louvered spring beams 178. The fingers 186 and 188 are also inclined relative to the strips 182 and 184.

Top and bottom multiple contact bands 170 are positioned along interior surfaces of a top wall 132 and a bottom wall 148 forming a receptacle section 130 of a terminal body 122 shown in FIG. 12. This one-piece terminal body 122 also includes a wire termination section 168. The top wall 132 is joined to the bottom wall 146 by straps 180 on one side of the terminal body. Straps 181 on the opposite side also extend form the bottom wall 146 into abutment with the lower surface of the top wall 132. The straps 181 do not grip the top wall 132.

Although the straps 181 prevent the free edge of the top wall from being inwardly deformed relative to the bottom wall 146, these straps 181 do not hold the top wall 132 parallel to the bottom wall 146. A stamped and formed sheet metal shroud 190 is wrapped around the terminal body 122, and holds the top wall 132 in abutment with the straps 181. In this way, the top wall 132 is held parallel to the bottom wall 146. The shroud 190 also has folded over clip sections 192 that are wrapped around the front and rear edges of both the top wall 132 and the bottom wall 146. These folded over clip sections 192 also overlap the fingers 186 and 188 on the multiple contact bands or spring members 170 to hold these spring members in engagement with the interior surfaces of the top and bottom walls. Although these clip sections 192 hold the spring members 170 in position, the fit is sufficiently loose so that the spring members can expand longitudinally when deformed by insertion or receipt of a rectangular blade terminal. One edge 194 of the shroud 190 is folded over an inner edge and this upper edge 194 functions as a keying member for insertion of the terminal 120 into a connector housing. The shroud 190 is held on the terminal body 122 by inwardly deflected tabs 196 that grip, the sides of the terminal body 122. These tabs 196 can be punched after the shroud has been inserted over the terminal body 122 or they can be formed prior to positioning the shroud 190 on the terminal body 122, in which case the shroud will expand as the terminal body 122 is inserted into the shroud 190. The shroud 190 also has an outwardly formed lance 198 on its upper surface to secure the terminal 120 in a connector housing in a conventional fashion.

Figure 16:
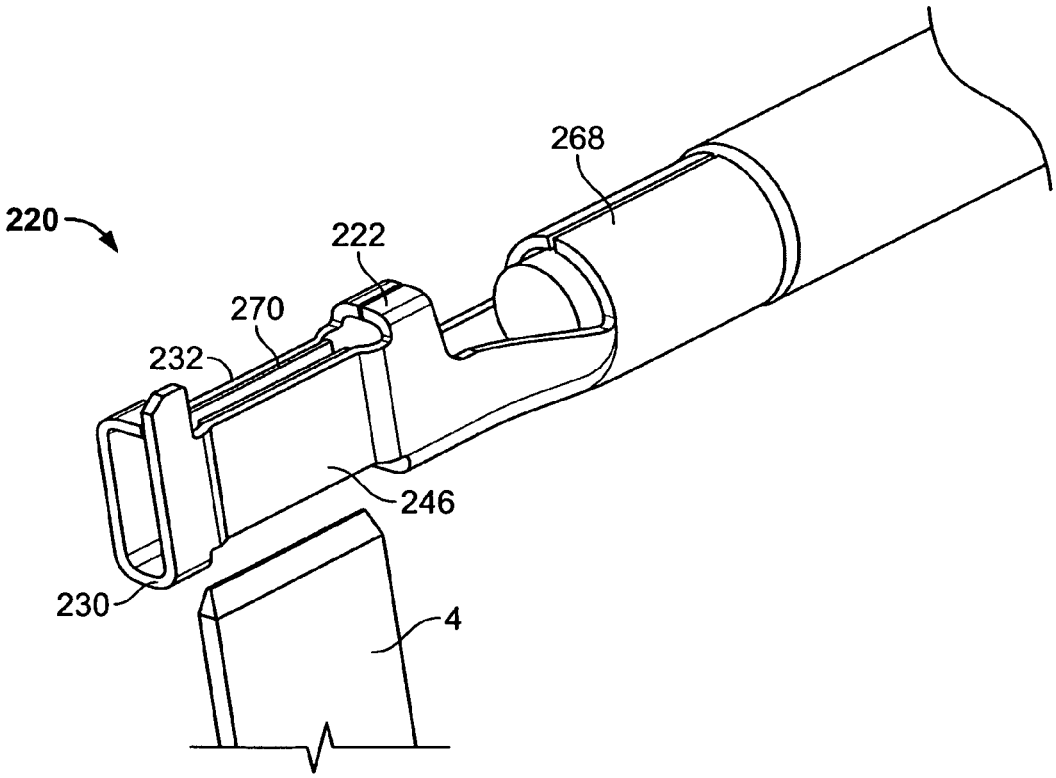
FIG. 16 is a view of a right angle version of a battery terminal in accordance with this invention.
Figure 17:
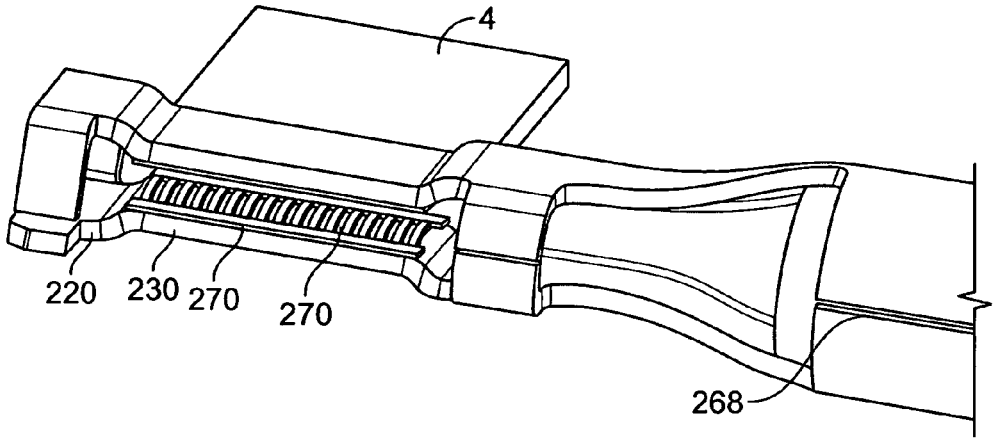
FIG. 17 shows the manner in which the right angle battery terminal of FIG. 16 engages a rectangular terminal blade on a battery.
Figure 18:
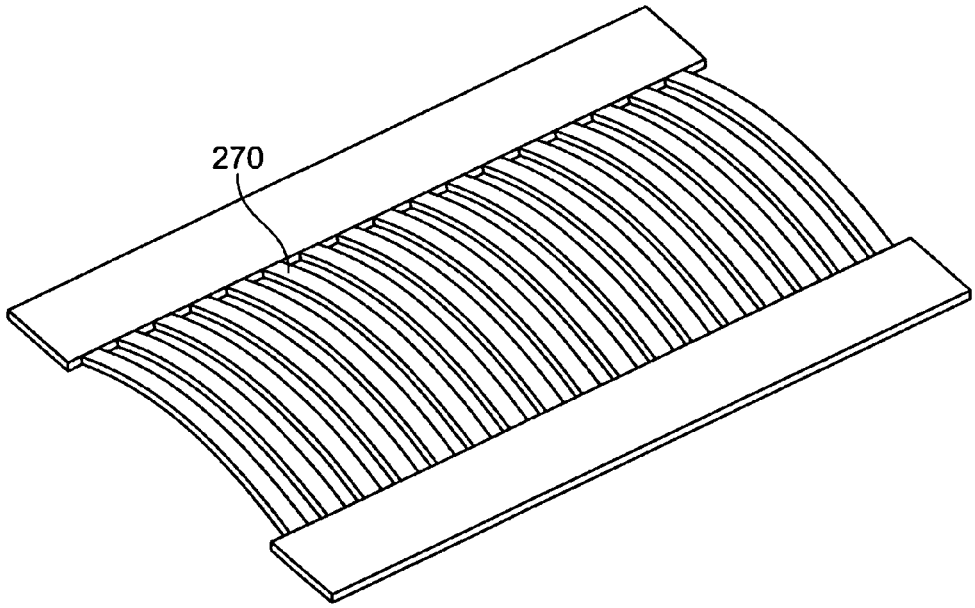
FIG. 18 is a view of contact terminal band that can be used in the embodiment of FIG. 16.

A fourth embodiment of this invention is shown in FIGS. 16–18. This embodiment consists of a right angle version of the high current battery terminal 220. The right angle version provides a lower profile and allows a battery cable 8 to extend at right angles relative to a rectangular flat blade 4. As shown in FIGS. 16 and 17, the right angle battery terminal 220 includes a terminal body 222 and a pair of multiple contact bands 270 that are similar to the multiple contact bands 70, 170 used in the other three embodiments. The terminal body 220 includes two opposed walls 232 and 246 that form a receptacle section 230. The terminal body 222 also includes a wire termination member 268 for attaching a battery cable 8 to the terminal. Two multiple contact bands 270 are mounted on interior surfaces of the two opposed walls 232 and 246. When a rectangular blade 4 is inserted into the receptacle section 230, the multiple contact spring bands 270 flex to generate a contact force with the blade 4 and with the terminal body 222. The individual contact bands or spring members 270 can be attached to the terminal body by welding one end of the spring bands to corresponding terminal body walls 232 and 246. The other end of the spring member is free to permit longitudinal movement when the blade 4 is inserted between multiple contact bands 270. Alternative, the mounting methods described with reference to the first three inline embodiments could be employed with this right angle version of the invention.

Figure 19:
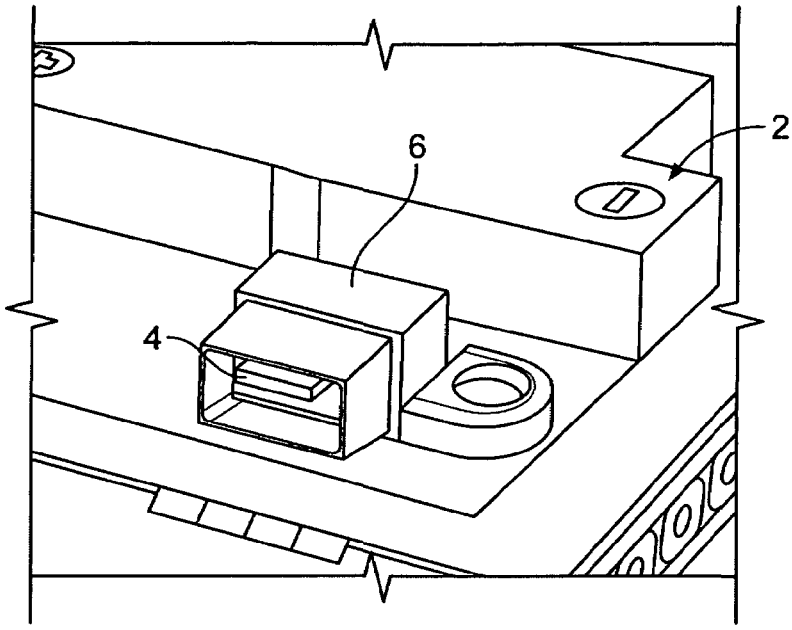
FIG. 19 is a view of a portion of a battery having a rectangular blade comprising the output of the battery.
Figure 20:
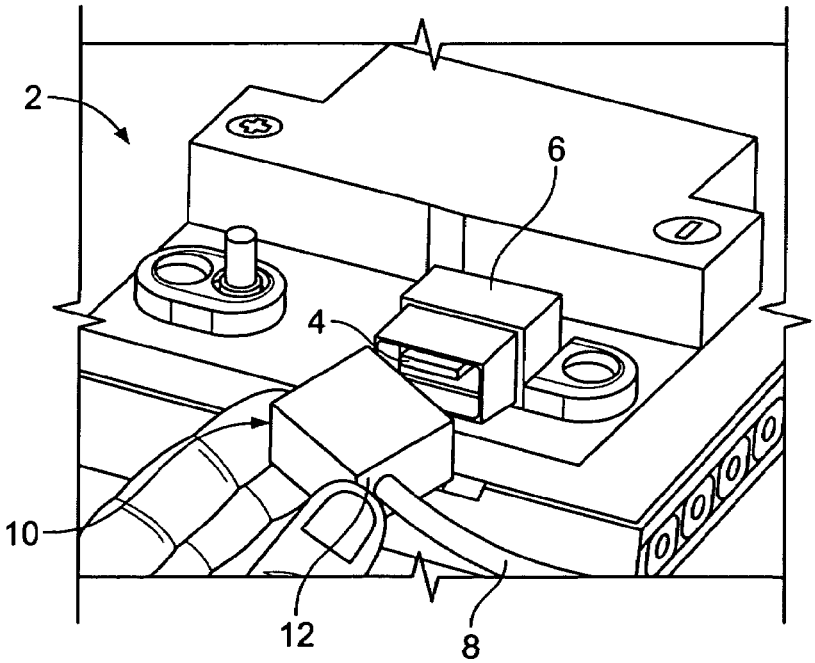
FIG. 20 is a view of a battery connector employing a right angle terminal blade.

FIGS. 19 and 20 show a 36 volt battery with which the terminals shown in the four embodiments can be employed. This battery 2 uses a rectangular blade 4 as a battery post. This blade 4 would be used for positive and ground battery posts. The blade 4 is mounted in a header cavity 6 with a surrounding header shroud. A battery connector 10 of the type shown in FIG. 20 would be plugged into this header cavity 6 so that the battery terminal in the battery connector would engage the rectangular blade 4. By employing a connector 10 that can be inserted into a header cavity 6, the connection between a battery cable 8 and the battery blade 4 can be sealed. The connector 10 shown in FIG. 20 is a right angle version of a battery connector. A right angle terminal, such as battery terminal 220 shown in FIGS. 16–18 would be mounted in an insulative housing 12, surrounding the terminal, to form this right angle battery connector 10. It should be understood that inline terminals 20 and 120 could also be employed in an inline battery connector to mate with the same type of battery.

The representative embodiments of this invention depicted herein are intended for use as a battery terminal. It should be understood, however, that receptacle terminals of the type depicted herein can be used in other applications. In particular, this terminal can be used at other connection points in a motor vehicle electrical system, especially in a 36 volt system. A terminal or connector system of this type can also be used in nonautomotive high current applications.

The embodiments shown in this invention are merely representative of other embodiments that would not materially differ from the versions shown herein. Therefore the invention represented by these embodiments is defined by the following claims and is not limited to the specific details shown herein.

The invention claimed is:

1. A terminal for connection to a flat blade, the terminal comprising:

a terminal body including a receptacle section and a wire termination section, the receptacle section having a pair of opposed flat walls and strap sections extending between the opposed flat walls, the strap sections on at least one side of the terminal body having swaged sections locked into notches in at least one of the opposed flat walls; and a pair of multiple contact bands formed from a material having a greater elasticity than the terminal body, one of the multiple contact bands being positioned along an interior surface of each terminal body wall, each contact band including spring beams, the contact bands being positioned so that the spring beams are deflected when the flat blade is inserted through a front of the terminal body and between opposed contact bands; and clips surrounding front edges of the opposed walls to attach the multiple contact bands to the receptacle section.

2. The terminal of claim 1 wherein the clips are part of the contact bands.

3. The terminal of claim 1 wherein the multiple contact bands are joined at an adjacent end of each band to form a one-piece member.

4. The terminal of claim 1 wherein the clips are formed on a shroud folded around the terminal body.

5. The terminal of claim 1 wherein the spring beams comprise curved members joined at opposite ends to laterally extending flat sections, the spring beams in each contact band together forming a common curved surface diverging from the laterally extending flat sections, the laterally extending flat sections bearing against an adjacent terminal body wall.

6. The terminal of claim 1 wherein each spring beam is twisted relative to flat sections at opposite ends of the spring beam so that the spring beams lie in a series of parallel surfaces.

7. The terminal of claim 1 wherein the strap sections have a depth that is less than the depth of the flat walls, so that the straps can be more easily bent.

8. The terminal of claim 1 wherein the swaged sections are located on tongues at free ends of the strap sections extending through notches on the one wall gripped by the swaged sections.

9. The terminal of claim 1 wherein front slots are profiled in front edges of the flat walls and a rear slot is profiled in rear edges of each flat wall, the contact bands including lances received within the front and rear slots to secure the multiple contact bands to the terminal body.

10. The terminal of claim 1 wherein rearwardly facing lances formed inwardly in each clip extend into front slots formed on the front edge of the terminal body receptacle section to secure the spring member when a mating terminal blade is inserted into engagement with the spring member.

11. The terminal of claim 1 wherein forwardly facing lances formed outwardly adjacent rear ends of the individual spring beams extend into rear slots in the terminal body receptacle section to prevent extraction of the spring member from the terminal body receptacle section.

12. The terminal of claim 3 wherein the clips are part of the contact bands.

13. The terminal of claim 4 wherein the clips are formed on opposite ends of the shroud to secure opposite ends of each contact band.

14. A terminal for use in an electrical connector, the terminal comprising:

a terminal body including a receptacle section joined to a wire termination section, the receptacle section having a pair of opposed flat walls and strap sections extending between the opposed flat walls, the strap sections on at least one side of the terminal body having swaged sections locked into notches in at least one of the opposed flat walls; and a spring member positioned with the receptacle section, the spring member comprising a stamped and formed member including opposed arrays of individual spring beams joined at rear ends by an inwardly folded section extending between the opposed arrays, each array of spring members joined at front ends to a clip outwardly folded around a forward end of the terminal body receptacle section, the spring member comprising means for engaging both the terminal body and a mating terminal blade received between the opposed arrays of individual spring beams.

15. The terminal of claim 14 wherein individual spring beams are twisted relative to the inwardly folded section and to the clip joined to the individual spring beams.

16. The terminal of claim 14 wherein first edges of the individual spring beams extend outwardly to engage the terminal body receptacle section and opposite second edges of the individual spring beams are positioned to engage the mating terminal blade received between the opposed arrays of individual spring beams.

17. The terminal of claim 14 wherein the individual spring beams are curved, the spring beams in each array lying in a single continuous curved surface.

18. A battery connector for connection to a rectangular battery header blade on a 36 volt battery, the battery header blade being located within a cavity, the battery connector comprising:

a single battery terminal positioned within a surrounding housing, the housing being insertable into the cavity with the single battery terminal engaging the rectangular battery blade; wherein, the battery terminal comprises;

a terminal body including a wire termination section for terminating a battery cable to the terminal body located on a rear end of the terminal body, and a receptacle section adjacent a front end of the terminal body, the receptacle section having opposed, flat, parallel wall sections and strap sections extending between the wall sections, the strap sections on at least one side of the terminal body having swaged sections locked into notches in at least one of the wall sections; and two stamped and formed spring members having a greater elasticity than the terminal body, each spring member including a plurality of side by side spring beams, each stamped and formed spring member being positioned on an interior surface of one of the wall sections with the two stamped and formed spring members being in opposing relationship, so that the rectangular battery blade can be received between the two stamped and formed spring members to deflect the spring members so that the battery terminal can be mated to the rectangular battery blade without excessive mating force.

19. The battery connector of claim 18 wherein the two stamped and formed spring members are joined by a central web located adjacent a rear edge of the spring members to form a one piece relatively elastic member.

20. The battery connector of claim 18 wherein the spring beams extend parallel to the orientation of the battery cable terminated in the means for terminating the battery cable.

21. The battery connector of claim 18 wherein the spring beams extend transversely to the orientation of the battery cable terminated in the means for terminating the battery cable.

22. The battery connector of claim 18 further comprising clips extending from each of the spring members and surrounding front edges of the wall sections to attach the spring members to the receptacle section.

23. The battery connector of claim 18 wherein the spring beams include curved bodies joined at opposite ends to laterally extending flat sections, the spring beams in each spring member together forming a common curved surface diverging from the laterally extending flat sections, the laterally extending flat sections bearing against an adjacent wall section.

* * * * *

UNITED STATES PATENT AND TRADEMARK OFFICE

CERTIFICATE OF CORRECTION

PATENT NO. : 7,150,660 B2
APPLICATION NO. : 10/480108
DATED : December 19, 2006
INVENTOR(S) : Christopher Lee Allgood et al.

It is certified that error appears in the above-identified patent and that said Letters Patent is hereby corrected as shown below:

On the Title Page: Item (75) Fourth inventor name should read

--Garold Michael Yurko--.

Signed and Sealed this

Twenty-second Day of May, 2007

JON W. DUDAS
*Director of the United States Patent and Trademark Office*